US010030313B2

(12) United States Patent
Yamamoto et al.

(10) Patent No.: US 10,030,313 B2
(45) Date of Patent: Jul. 24, 2018

(54) PLATING APPARATUS AND CONTAINER BATH

(71) Applicants: YAMAMOTO-MS Co., Ltd., Shibuya-ku, Tokyo (JP); KIYOKAWA Plating Industry Co., Ltd., Fukui-shi, Fukui (JP)

(72) Inventors: Wataru Yamamoto, Tokyo (JP); Fumio Harada, Tokyo (JP); Hajime Kiyokawa, Fukui (JP)

(73) Assignees: YAMAMOTO-MS., Co. Ltd., Tokyo (JP); KIYOKAWA Plating Industry Co., Ltd., Fukui (JP)

( * ) Notice: Subject to any disclaimer, the term of this patent is extended or adjusted under 35 U.S.C. 154(b) by 71 days.

(21) Appl. No.: 15/100,446

(22) PCT Filed: Apr. 16, 2015

(86) PCT No.: PCT/JP2015/061726
§ 371 (c)(1),
(2) Date: May 31, 2016

(87) PCT Pub. No.: WO2015/174204
PCT Pub. Date: Nov. 19, 2015

(65) Prior Publication Data

US 2016/0305032 A1 Oct. 20, 2016

(30) Foreign Application Priority Data

May 12, 2014 (JP) ..... 2014-098446

(51) Int. Cl.
*C25B 9/00* (2006.01)
*C25D 5/08* (2006.01)
(Continued)

(52) U.S. Cl.
CPC ..... *C25D 5/08* (2013.01); *C23C 18/163* (2013.01); *C23C 18/1619* (2013.01);
(Continued)

(58) Field of Classification Search
CPC ..... C25B 9/00; C25D 17/001; C25D 17/00; C25D 5/08
(Continued)

(56) References Cited

FOREIGN PATENT DOCUMENTS

CN 2839303 Y 11/2006
JP 2003-124214 A 4/2003
(Continued)

OTHER PUBLICATIONS

Office Action for Chinese Patent Application No. 201580004879.X, dated Apr. 18, 2017.
(Continued)

*Primary Examiner* — Zulmariam Mendez
(74) *Attorney, Agent, or Firm* — Merchant & Gould P.C.

(57) ABSTRACT

Provided are a plating apparatus and a container bath, which have a simpler structure than a conventional system and are capable of improving uniformity of a plating thickness. The plating apparatus includes a plating tank which stores a plating liquid, an anode member arranged inside the plating tank, a plating object arranged inside the plating tank to face the anode member, a cathode jig which contacts with the plating object, and a space formed between the anode member and the plating object to be a flow passage to which the plating liquid flows from the plating tank. The plating liquid flows into the space from above relative to the space, and is sucked by a pump from below relative to the space.

5 Claims, 9 Drawing Sheets

(51) Int. Cl.

| | |
|---|---|
| ***C25D 17/02*** | (2006.01) |
| ***C23C 18/16*** | (2006.01) |
| ***C25D 17/00*** | (2006.01) |
| *C25D 3/38* | (2006.01) |
| *C25D 17/06* | (2006.01) |
| *C25D 17/10* | (2006.01) |
| *C25D 21/10* | (2006.01) |

(52) U.S. Cl.
CPC ..... *C23C 18/1664* (2013.01); *C25D 17/00* (2013.01); *C25D 17/02* (2013.01); *C23C 18/1632* (2013.01); *C25D 3/38* (2013.01); *C25D 17/005* (2013.01); *C25D 17/06* (2013.01); *C25D 17/10* (2013.01); *C25D 21/10* (2013.01)

(58) Field of Classification Search
USPC ..... 204/237
See application file for complete search history.

(56) References Cited

FOREIGN PATENT DOCUMENTS

| | | | |
|---|---|---|---|
| JP | 2004-339590 | A | 2/2004 |
| JP | 2006-519932 | A | 8/2006 |
| JP | 2009-91597 | A | 4/2009 |
| JP | 2013-112868 | A | 6/2013 |
| WO | 2011/105072 | A1 | 9/2011 |

OTHER PUBLICATIONS

International Search Report for International Application No. PCT/JP2015/061726 dated May 19, 2015 (1 page).
International Written Opinion for International Application No. PCT/JP2015/061726 dated May 19, 2015 (3 page).
Search Report for European Patent Application No. 15793615.4, dated Nov. 20, 2017.

PLATING APPARATUS AND CONTAINER BATH

This application is a National Stage Application of PCT/JP2015/061726, filed on Apr. 16, 2015, which claims benefit of Serial No. 2014-098446, filed on May 21, 2014 and which applications are incorporated herein by reference. To the extent appropriate, a claim of priority is made to the above disclosed applications.

TECHNICAL FIELD

The present invention relates to a plating apparatus and a container bath.

BACKGROUND ART

It is generally known that a higher value of current flowing through anode and cathode members makes plating growth faster, thereby improving productivity of plating. However, such a higher value of current is likely to cause plating burning of anode and cathode members, which increases a risk of plating defects.

In this regard, such an injection plating apparatus is known that is capable of preventing plating defects while improving plating productivity. That injection plating apparatus carries out a plating process via injecting a plating liquid through a plurality of nozzles toward a plating object to be plated in the process (e.g., referring to Patent Documents 1 and 2).

CITATION LIST

Patent Documents

[Patent Document 1] Japanese Unexamined Patent Application Publication (Translation of PCT Application) No. 2006-519932

[Patent Document 2] Japanese Unexamined Patent Application Publication No. 2003-124214

SUMMARY OF INVENTION

Technical Problems to be Solved by the Invention

Meanwhile, when a conventional injection plating apparatus injects a plating liquid onto a plating object, different types of areas are formed on the plating object. One is an area easily fed with a plating liquid, while the other is an area failing in feed. This difference causes a drawback of decreasing the uniformity of a plating thickness.

The above drawback is generally dealt with a method for injecting a plating liquid through nozzles onto an plating object while rotating a cathode member which holds the plating object.

However, this method requires an additional driving mechanism of rotating a cathode member as well as a plurality of nozzles, which makes a plating apparatus more complicated in configuration and larger in size, resulting in increase in the costs.

The present invention has been made in view of the above drawbacks of the prior art. Therefore, the present invention is directed to a plating apparatus and a container bath, which have a simpler structure than a conventional system and are capable of improving uniformity of a plating thickness.

Means for Solving the Problems

For solving the above drawbacks, provided is a plating apparatus comprising a plating tank storing a plating liquid, an anode member arranged inside the plating tank, a plating object arranged to face the anode member, and a space formed between the anode member and the plating object to be a flow passage to which the plating liquid flows from the plating tank. Herein, the plating liquid flows into the space from above relative to the space and is sucked by a pump from below relative to the space.

In the present invention, a plating liquid flows into the space from above relative to the space and is sucked by a pump from below relative to the space. Due to this construction, a flow rate of the plating liquid inside the space increases. This allows the plating liquid to be uniformly fed onto the plating object, thereby improving the uniformity of the plating thickness. Further, according to the present invention, nozzles and a driving mechanism are not necessary, which realizes a plating apparatus with a simple and downsizing construction, resulting in suppression of the costs.

Further, preferably the space has such a structure that both end sides of the space are closed in a direction orthogonal to a direction in which the anode member faces the plating object.

In this construction, both end sides of the space are closed in a direction orthogonal to a direction in which the anode member faces the plating object. This construction prevents the plating liquid from entering through the sides of the space, allowing the plating liquid to flow as a laminar flow parallel to the longitudinal direction of the plating object.

Further, the plating tank preferably includes a first holder detachably holding the anode member, and a second holder detachably holding the plating object.

In the above construction, the plating tank includes a first holder detachably holding the anode member, and a second holder detachably holding the plating object. This construction allows the anode member and the plating object to be easily aligned with respect to the plating tank, and ensures reliable holding of the anode member and the plating object.

Moreover, preferably a width dimension of the space along the facing direction between the anode member and the plating object is set so that the plating liquid flows as a laminar flow parallel to the longitudinal direction of the plating object.

In the above construction, a flow rate of the plating liquid inside the space increases, and the plating liquid flows as a laminar flow parallel to the longitudinal direction of the plating object Further, for solving the drawbacks described hereinbefore, the present invention is directed to a container bath arranged inside a plating tank which stores a plating liquid. The container bath includes an anode member housed thereinside, a plating object housed thereinside and arranged facing the anode member, a cathode member contacting on the plating object, and a space formed between the anode member and the plating object to be a flow passage to which the plating liquid flows from the plating tank. Herein, the plating liquid flows into the space from above relative to the space and is sucked by a pump from below relative to the space.

In the present invention, a plating liquid flows into the space from above and is sucked by a pump from below relative to the space. This construction facilitates a flow rate of the plating liquid inside the space to increase, which helps the plating liquid uniformly fed onto the plating object, thereby to improve uniformity of a plating thickness. Further, in the present invention, nozzles and a driving mechanism are not necessary to be provided. Therefore, those advantages realize the simplification and downsizing of a plating apparatus, thereby suppressing the costs. Moreover, in the present invention, a conventional plating tank may be used for housing a container bath, leading to an advantage of high versatility.

For solving the drawbacks described hereinbefore, the present invention is directed to a plating apparatus provided with a plating tank storing a plating liquid, side walls of the plating tank, a plating object arranged inside the plating tank to face one of the side walls, and a space formed between said side wall and the plating object to be a flow passage to which the plating liquid flows from the plating tank. Herein the plating liquid flows into the space from above relative to the space and is sucked by a pump from below relative to the space.

Further, the present invention solving the drawbacks described hereinbefore is directed to a container bath arranged inside a plating tank storing a plating liquid. The container bath is provided with lateral sides of the container bath, a plating object arranged inside the container bath to face one of the lateral sides, a space formed between said lateral side and the plating object to be a flow passage to which the plating liquid flows from the plating tank. Herein, the plating liquid flows into the space from above relative to the space and is sucked by a pump from below relative to the space.

Moreover, even when the present invention is applied to electroless plating, a plating liquid flows into the space from above relative to the space and is sucked by a pump from below relative to the space. This construction facilitates a flow rate of the plating liquid inside the space to increase. Thus, the plating liquid is easy to be uniformly fed onto the plating object, resulting in improvement of uniformity of a plating thickness. Furthermore, in the present invention, nozzles and a driving mechanism are not necessary to be provided. Those advantages realize simplification and downsizing of the plating apparatus, thereby suppressing the costs.

Advantageous Effect of the Invention

According to the present invention, a plating apparatus and a container bath, which have a simpler structure than a conventional system and are capable of improving uniformity of a plating thickness, may be provided.

EMBODIMENTS FOR CARRYING OUT THE INVENTION

Figure 1:
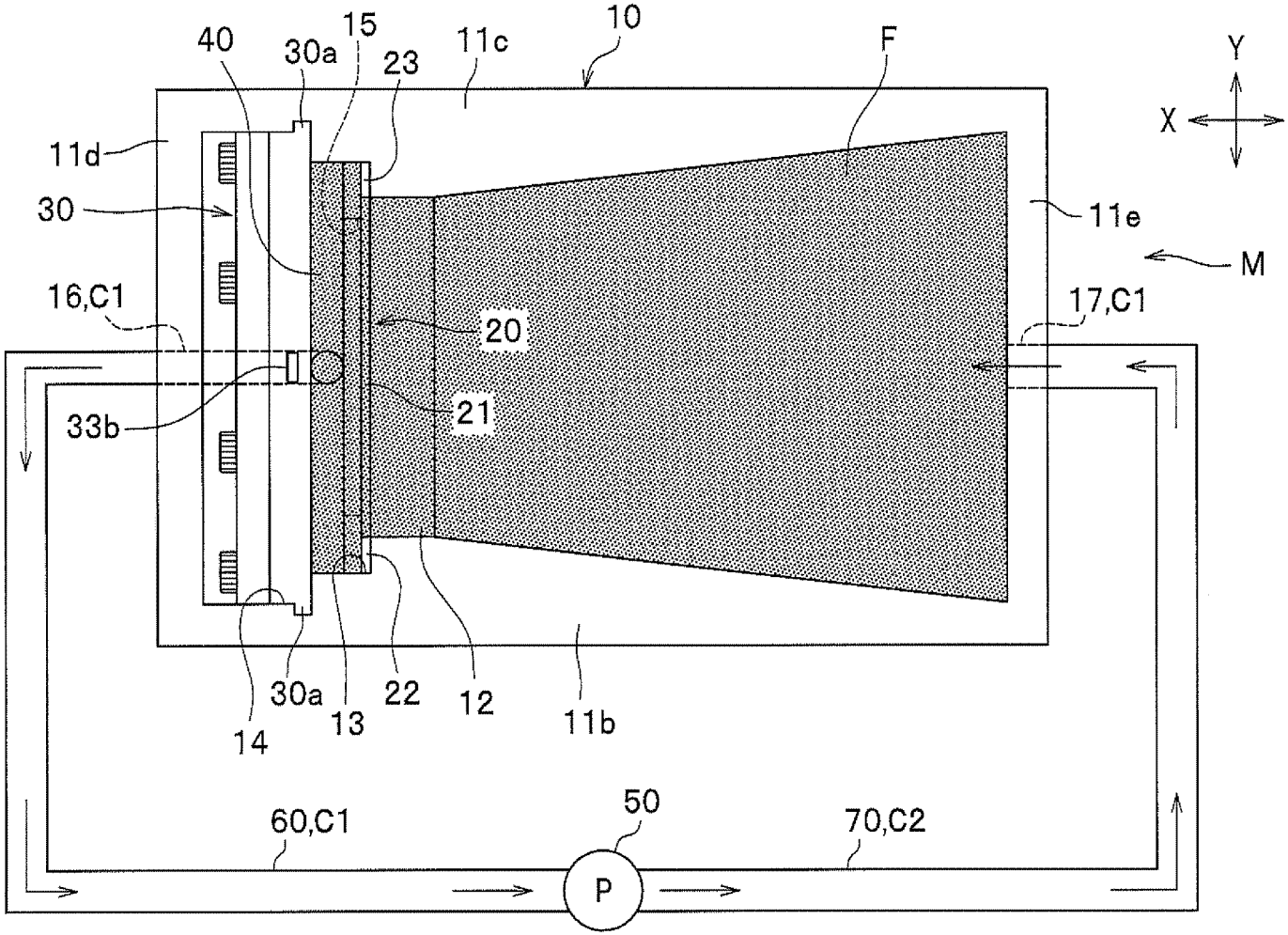
FIG. 1 is a plan view of a plating apparatus according to a first embodiment of the present invention.

Hereinafter, embodiments of the present invention will be described in detail referring to the drawings attached hereto. In the descriptions, the same components are put with the same signs and overlapped descriptions will be omitted. Note that in the following descriptions, a direction in which an anode member 20 faces a plating object W is referred to a "facing direction X", and a direction orthogonal to the "facing direction X" is referred to an "orthogonal direction Y".

Figure 2:
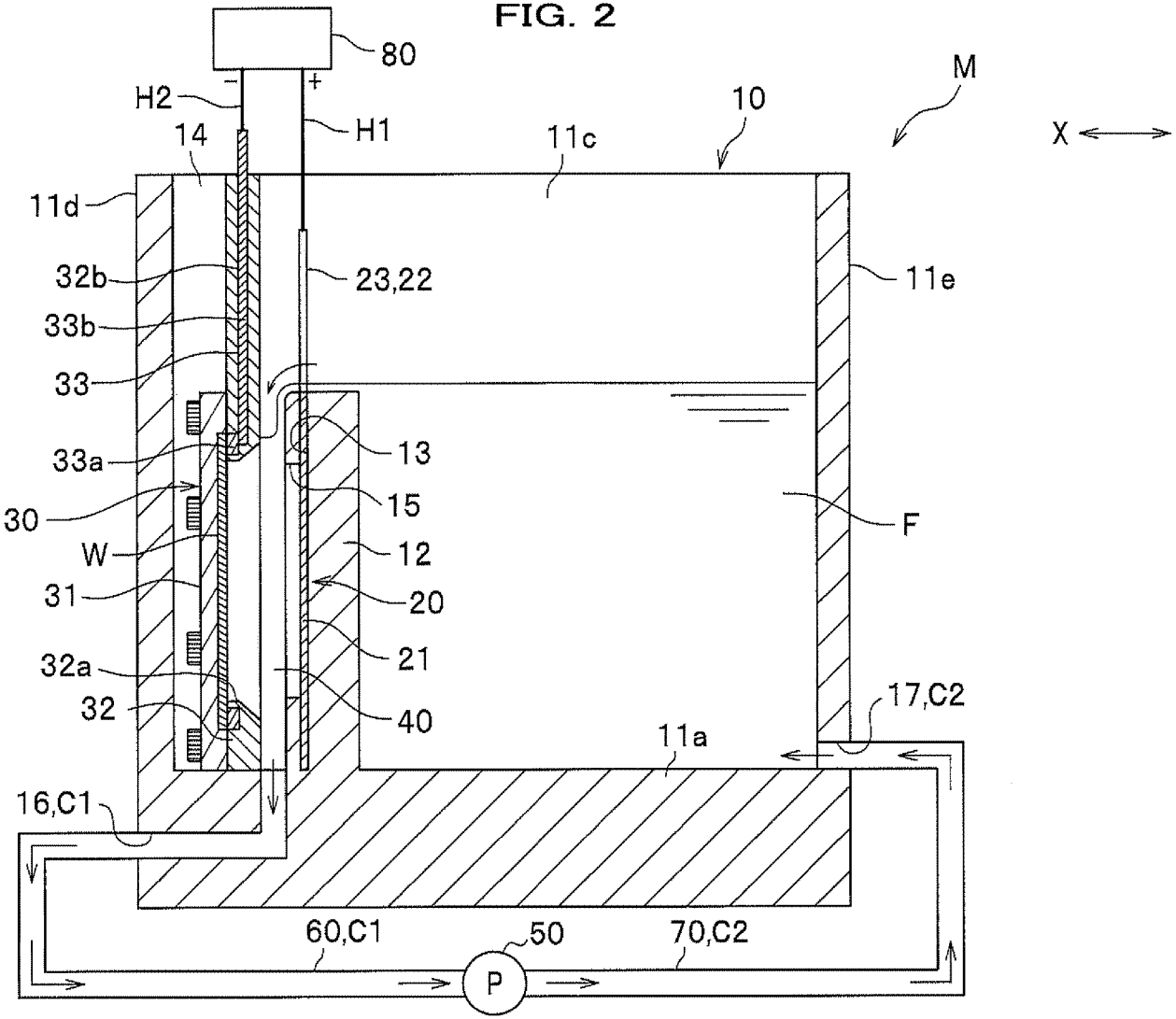
FIG. 2 is a longitudinal cross-sectional view of a plating apparatus according to a first embodiment of the present invention.

As shown in FIGS. 1 and 2, a plating apparatus M of the first embodiment includes a plating tank 10, an anode member 20, a cathode jug 30, a space 40, and a pump 50. Herein, the dot hatched area represents a region in which a plating liquid F resides.

<Plating Tank>

The plating tank 10 is configured to store the plating liquid F as shown in FIGS. 1 and 2. The plating tank 10 is a vessel provided with a bottom 11*a*, a pair of side walls 11*b* and 11*c* facing each other in the orthogonal direction Y, and a pair of side walls 11*d* and 11*e* facing each other in the facing direction X. The plating tank 10 is shaped in a box vessel having an upper opening, and made of resin. The plating liquid F is stored only in a region behind the anode member (i.e., perpendicular wall 12) opposite to the space 40 in the plating tank 10. The plating tank 10 is shaped in a rectangular in a plan view and arranged so that the longitudinal direction thereof coincidences with the facing direction X. Note that a shape and a material of the plating tank 10 may be appropriately modified.

As shown in FIG. 2, the plating tank 10 is provided with a perpendicular wall 12 projected upward from an inner side of the bottom 11*a* of the plating tank 10, a first holder 13 detachably holding the anode member 20, a second holder 14 detachably holding the cathode jig 30, a plating communication hole 15 communicating the first holder 13 to the space 40, and a suction hole 16 and a discharge hole 17 through which the plating liquid F passes.

The perpendicular wall 12, which is a wall unit, is a wall shaped part arranged near the side wall 11*d* of the plating tank 10. Both sides of the perpendicular wall 12 in the orthogonal direction Y are continuously formed to be integral with internal surfaces of the side walls of 11*b* and 11*c* of the plating tank 10 (see FIG. 1). An upper side of the perpendicular wall 12 is located at a lower position than a level of the plating liquid F and upper ends of the side walls 11*b* and 11*e*. In this construction, the plating liquid F flows over the perpendicular wall 12 into the space 40 as described later. Herein, the perpendicular wall 12 may be separately formed from the plating tank 10, and subsequently attached to the plating tank 10.

The first holder 13 is a hole shaped in groove and slit having an upper opening. The first holder 13 is formed from the upper end to the lower end of the perpendicular wall 12 and arranged thereon at the closer side to the cathode jig 30. The anode member 20 is inserted into the first holder 13 to be held thereon.

As shown in FIG. 1, the second holder 14 is a part formed in a concave-convex shape corresponding to the outer shape of the cathode jig 30. The cathode jig 30 is inserted into the second holder 14 to be held thereon. The second holder 14 sandwiches protrusion parts 30*a* from the both sides thereof in the facing direction X, the protrusion parts 30*a* being formed at the ends of the cathode jig 30 and arranged at the closer side to the anode member 20. Herein, the cathode jig 30 may be held on the perpendicular wall 12, and the anode member 20 may be held on the wall sides 11*b* and 11*c*.

As shown in FIG. 2, the plating communication hole 15 is a through hole exposing the anode member 20 to the space 40. The plating communication hole 15 is formed at the middle part in the longitudinal direction of the perpendicular wall 12.

The suction hole 16 is a thorough hole to be a part of a suction flow passage C1 through which a plating liquid F sucked from the space by the pump 50 passes. The suction hole 16 is formed penetrating the bottom 11*a* of the plating tank 10 from the upper side to the lateral side of the bottom 11*a*. The suction hole 16 extends from the upper side to the lower side of the bottom 11*a*, and further extends to one way of the facing direction X. One end of the suction hole 16 is opened toward a lower part of the space 40. A suction pipe 60 communicating the suction hole 16 to the pump 50 is connected with the other end of the suction hole 16. That is, the suction hole 16 and the suction pipe 60 configure the suction flow passage C1.

The discharge hole 17 is a thorough hole to be a part of a discharge flow passage C2 through which a plating liquid F discharged by the pump 50 passes. The discharge hole 17 is formed penetrating the side wall 11*e* of the plating tank 10 from the outer surface to the inner surface of the side wall 11*e*. One end of the discharge hole 17 is opened toward a region placed behind the anode member 20 opposite to the space 40 in the plating tank 10. A discharge pipe 70 communicating the discharge hole 17 to the pump 50 is connected with the other end of the discharge hole 17. That is, the discharge hole 17 and the discharge pipe 70 configure the discharge flow passage C2.

<Anode Member>

As shown in FIGS. 1 and 2, the anode member 20 is a metallic member having a rectangular and plate shape and arranged inside the plating tank 10. The anode member 20 is configured so that a center 21 thereof in the orthogonal direction Y is located at a lower position than both end parts 22 and 23 of the anode member 20 in the orthogonal direction Y. The upper end of the center 21 of the anode member 20 is formed horizontal, and located at the same height as the upper end of the perpendicular wall 12. Both upper ends of the end parts 22 and 23 of the anode member 20 protrude higher than a level of the plating liquid F. In this construction, the plating liquid F flows into the space 40 only over the center 21 of the anode member 20 as described later. Herein, both the end parts 22 and 23 are connected to a plus terminal of a power source 80 through a connecting cable H1.

<Cathode Jig>

As shown in FIGS. 1 and 2, the cathode jig 30 has a function of a cathode member as well as a function of holding a plating object W. Herein, the cathode jig 30 and the plating object W are arranged inside the plating tank 10 to face the anode member 20.

As shown in FIG. 2, the cathode jig 30 includes a pair of holding members 31 and 32 which hold the plating object W, and an electrode 33 which transmits electricity from the power source 80 to the plating object W via contacting therewith.

A plating opening 32*a* is formed horizontally penetrating the holding member 32 arranged beside the space 40. The plating opening 32*a* allows the plating object W to be exposed to the space 40 so that the plating liquid F contacts with the plating object W.

The electrode 33 includes a contacting unit 33*a* shaped in a ring contacting with a periphery of the plating object W, and a power source connector 33*b* shaped in a strip connected to the power source 80. The power source connector 33*b* is inserted into an insertion hole 32*b* formed inside the holding member 32. An upper end of the power source connector 33*b* is located at a higher position than a level of the plating liquid F. The power source connector 33*b* is connected with a minus terminal of the power source 80 through a connecting cable H2. An upper end of the cathode jig 30 is located at a higher position than a level of the plating liquid F, and both ends of the cathode jig 30 in the orthogonal direction Y contact with the side walls 11*b* and 11*c* of the plating tank 10 without a gap. This construction prevents a plating liquid F, which flows into the space 40 from a region beside the anode member 20 in the plating tank 10, from entering a backside of the cathode jig 30. Herein, the construction of the cathode jig 30 may be appropreatpy modified, and a cathode plate may be used instead of the cathode jig 30.

<Space>

Figure 3:
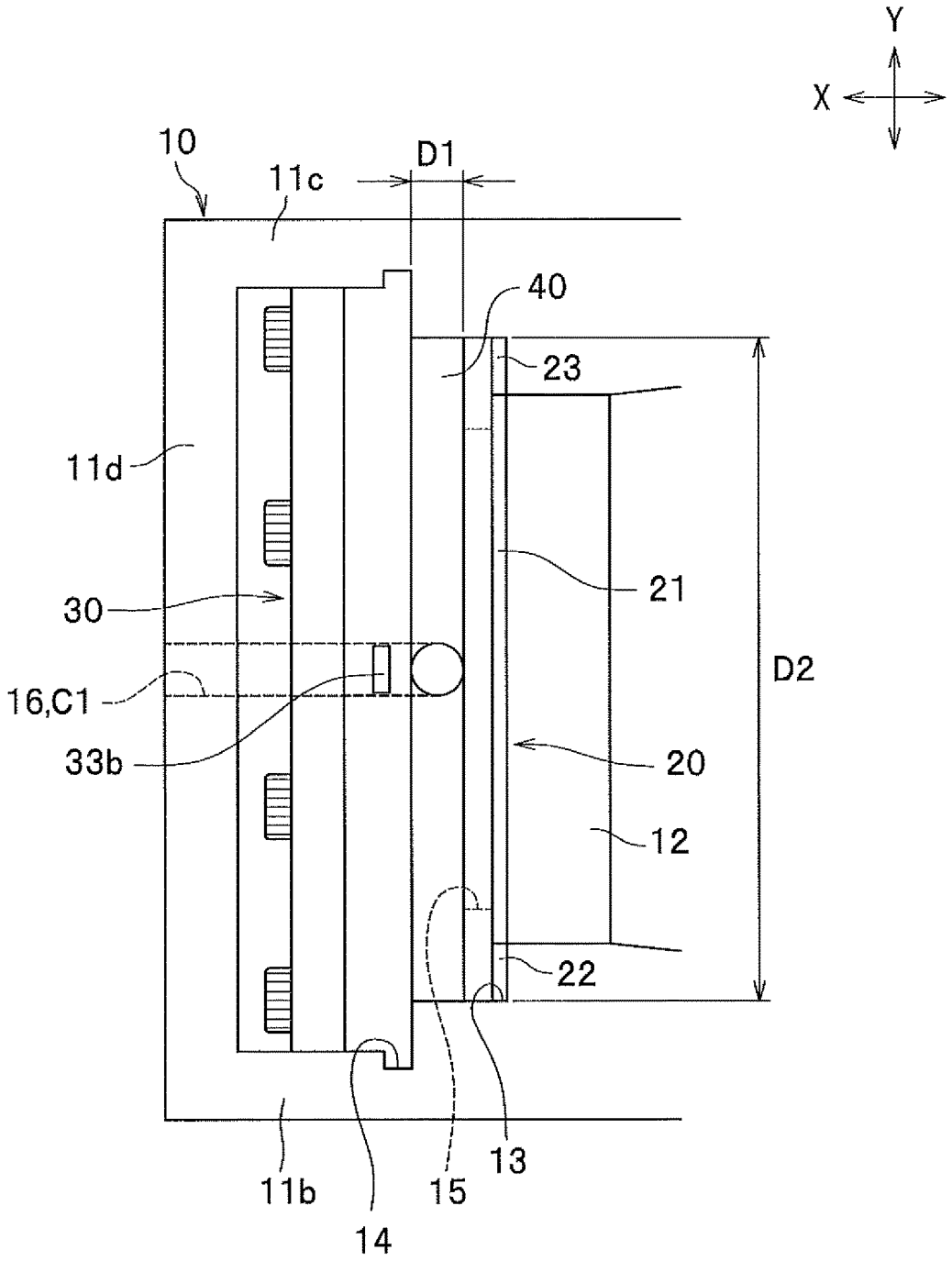
FIG. 3 is an enlarged plan view of a part of FIG. 1.

As shown in FIGS. 1 and 2, the space 40 is formed between the anode member 20 and the cathode jig 30 (and the plating object W) to be a flow passage to which the plating liquid F flows from the plating tank 10. The space 40 is a narrow space shaped in a slit form having an upper opening. Both sides of the space 40 in the orthogonal direction Y are closed by the side walls 11*b* and 11*c* of the plating tank 10. As shown in FIG. 3, the space 40 is formed so that a dimension D1 in the facing direction X is smaller than a dimension D2 in the orthogonal direction Y (i.e., D1<D2).

Preferably, the dimension D1 in the facing direction X is set in the range from about 1 mm to about 3 mm. Further, a flow rate of the plating liquid F flowing through the space 40 is preferably set in the range from about 0.1 m/s to about 3 m/s. Herein, a flow rate of the plating liquid F depends on the dimension D1 of the space 40 in the facing direction X and a performance of the pump 50. Therefore, the flow rate thereof may be appropriately adjusted by changing the above factors.

<Pump>

As shown in FIGS. 1 and 2, the pump 50 is arranged outside the plating tank 10. The pump 50 sucks the plating liquid F from the space 40 and discharges the plating liquid F thus sucked into the plating tank 10.

The plating apparatus M according to the first embodiment of the present invention is basically configured as mentioned hereinbefore. Next, the movement and effects thereof will be described in detail.

As shown in FIGS. 1 and 2, when the pump 50 is driven, the plating liquid F in the space 40 is sucked. Associated with the suction, the plating liquid F in the plating tank 10 flows over the perpendicular wall 12 and the center 21 of the anode member 20, thereby to flow into the space 40 from above relative to the space 40.

At that time, both sides of the space 40 in the orthogonal direction Y are closed by the side walls of the plating tank 10. Thus, this construction prevents the plating liquid F from entering the space 40 through the sides thereof. Further, the plating liquid F is stored only in a region behind the anode member 20 opposite to the space 40 in the plating tank 10. Due to this construction, the plating liquid F flows into the space 40 from only one side of the anode member 20 (i.e., via only one way in the facing direction X). This construction facilitates the plating liquid F to smoothly flow from the plating tank 10 into the space 40 (i.e., suppressing the interference among flow layers of the plating liquid F as much as possible). Thereby, disruption between the flow layers of the plating liquid F in the space 40 may be prevented.

Then, the plating liquid F flows into the space 40 from an upper portion to a lower portion thereof. At that time, if the power source 80 is turned on to allow the current to flow through the anode member 20 and the electrode 33, metal ions in the plating liquid F are drawn toward the cathode jig 30, thereby disposed on the plating object W to form a plating layer. Note a plating thickness may be adjusted by appropriately modifying a flow rate of the plating liquid F in the space 40 and a current value of the power source 80.

Next, the plating liquid F is sucked by the pump 50 from below relative to the space 40, thereby flowing through the suction flow passage C1 toward the pump 50.

The plating liquid F thus reached the pump 50 is discharged from the pump 50, and subsequently returned through the discharge flow passage C2 to the plating tank 10.

According to the present embodiment described above, the plating liquid F flows into the space 40 from above relative to the space 40, and is sucked by the pump 50 from below relative to the space 40. Due to this construction, accordingly, the flow rate of the plating liquid F in the space 40 increases. This facilitates the plating liquid F to be uniformly fed onto the plating object W, resulting in improvement of the uniformity of the plating thickness. Further, in the present embodiment, nozzles and a driving mechanism are not necessary to be provided, which realizes the simplification and downsizing of the plating apparatus, leading to suppression of the costs.

According to the present embodiment, the plating liquid F in the space 40 is continuously replaced. Thus, even if a large current flows from the power source 80, plating burning is prevented from occurring at the anode member 20 and the electrode 33. This suppresses plating defects from occurring. Therefore, fast and uniform growth of a plating layer may be achieved, resulting in improvement of the plating productivity.

More specifically, in a common cupper sulfate plating method, electric plating is needed to be carried out at a current density of about 1-2 A/dm$^2$. On the contrary, in the present invention, a flow rate of the plating liquid F in the space 20 is increased and the plating liquid F in the space 20 is continuously replaced. This feature enables electroplating to be carried out at a current density of about 4-5 A/dm$^2$, resulting in decrease in the plating time.

According to the present embodiment, both sides of the space 40 in the orthogonal direction Y are closed by the side walls of the plating tank 10. This construction prevents the plating liquid F from entering the space 40 through the sides thereof. Further, the dimension D1 of the space 40 in the facing direction X is set in the narrow width of from 1 mm to 30 mm. This construction enables the plating liquid F flows as a laminar flow parallel to the longitudinal direction of the plating object W.

According to the present embodiment, the plating tank 10 includes the first holder 13 detachably holding the anode member 20, the second holder 14 detachably holding the cathode jig 30. Therefore, the anode member 20 and the cathode jig 30 (i.e., and the plating object W) are easily aligned with the plating tank 10. Further, the anode member 20 and the cathode jig 30 are securely held.

According to the present embodiment, the space 40 is formed between the anode member 20 and the cathode jig 30 (i.e., and the plating object W), and the plating liquid F flows ino the space 40 from above and downward relative to the space 40. Accordingly, even when a small sized pump 50 is used, the flow rate of the plating liquid F may be sufficiently kept higher. Further, the use of the small sized pump 50 may realize further downsizing of the plating apparatus M.

According to the present embodiment, the plating liquid F is circulated by the pump 50. This circulation allows recycling of the plating liquid F so as to eliminate wastes.

Next, referring to FIGS. 4-7, a plating apparatus M in the second embodiment of the present invention will be described specifically. The plating apparatus M in the second embodiment includes a container bath 90 which houses an anode member 20 and a cathode jig 30, and a general plating tank 10 having no first and second folders 13 and 14, which is different from the first embodiment. Note in the plating apparatus M of the second embodiment, the anode member 20, the cathode jig 30 and the pump 50 are the same as in the first embodiment. Therefore, the descriptions of those components will be omitted.

Figure 4:
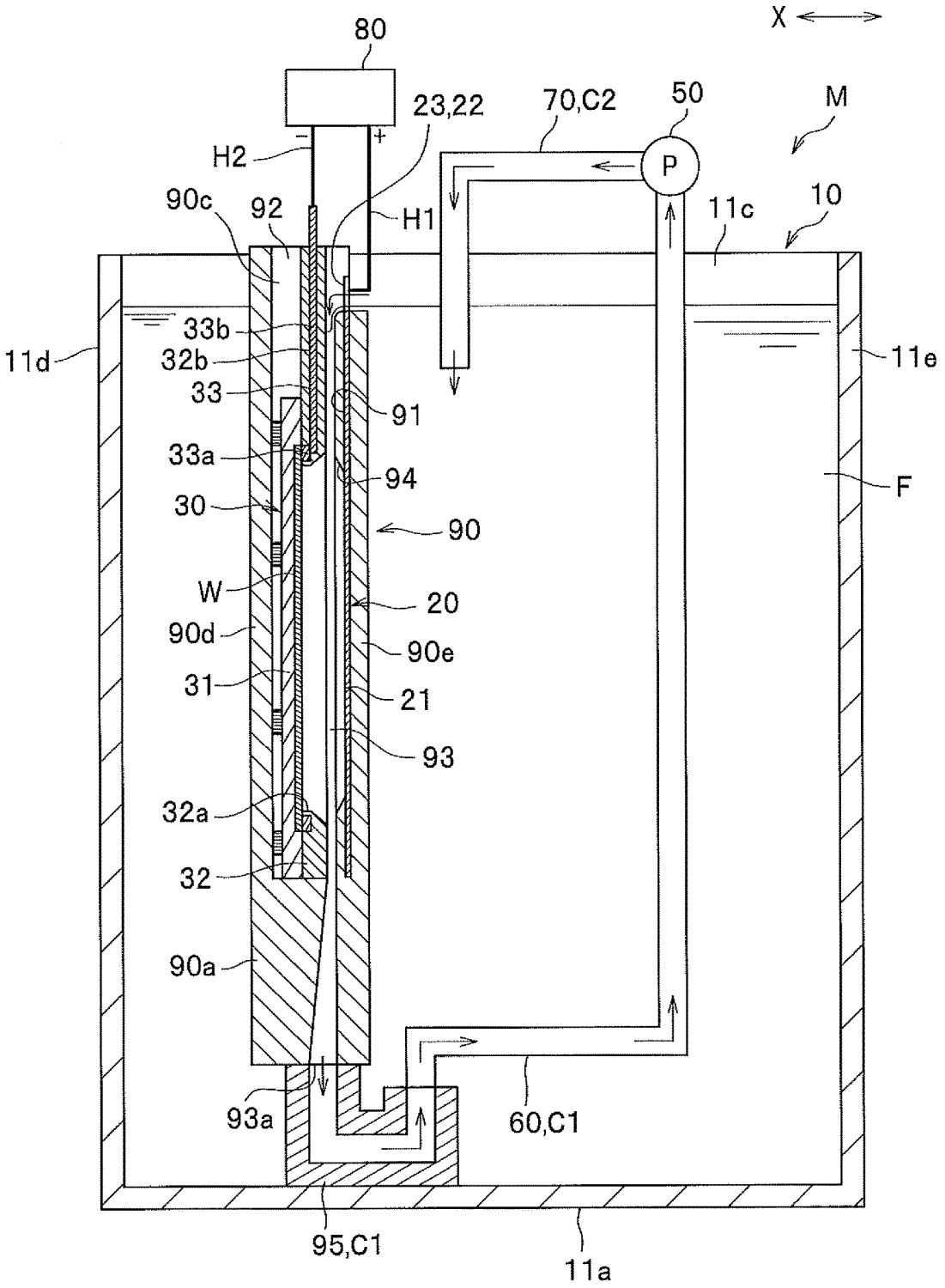
FIG. 4 is a plan view of a plating apparatus according to a second embodiment of the present invention.

As shown in FIG. 4, the container bath 90 is arranged inside the plating tank 10, and has a function of housing the anode member 20 and the cathode jig 30. The container bath 90 includes a bottom 90*a*, a pair of lateral sides 90*b* and 90*c* facing each other in the orthogonal direction Y, and a pair of lateral sides 90*d* and 90*e* facing each other in the facing direction X. The container bath 90 is an approximately square cylindrical vessel having an upper opening and made of resin. Note a shape and a material of the container bath 90 may be appropriately modified.

The container bath 90 includes a first holding unit 91 detachably holding the anode member 20, a second holding unit 92 detachably holding the cathode jig 30, a space 93 formed between the anode member 20 and the cathode jig 30 (i.e., and a plating object W), a plating communication hole 94 communicating the first holding unit 91 with the space 93, and a connector 95 connected to a lower portion (i.e., a downstream end) of the space 93.

The first holding unit 91 is a hall shaped in a groove and slit-like having an upper opening. The first holding unit 91 is formed from the upper end to the lower end of the lateral side 90*e*, and arranged at the closer side to the cathode jig 30. The anode member 20 is inserted into the first holding unit 91 and held therein. The upper end of the lateral side 90*c* is located at a lower position than a level of the plating liquid F and the upper ends of the side walls 11*b*-11*e*. This construction let the plating liquid F flow over the upper end of the lateral side 90*e* to flow into the space 93, as described later. Note the upper end of the center 21 of the anode member 20 is located at the same height as the upper end of the lateral side 90*e*.

The second holding unit 92 is a part formed in an uneven shape corresponding to an outer shape of the cathode jig 30. The second holding unit 92 is formed on the inner surfaces of the lateral sides 90*b* and 90*c* of the container bath 90. The cathode jig 30 is inserted into the second holding unit 92 and held. The second holding unit 92 sandwiches protrusion parts 30*a* from the both sides thereof in the facing direction X, the protrusion parts 30*a* being formed at the ends of the cathode jig 30 and arranged at the closer side to the anode member 20 (see FIG. 7). The upper end of the lateral side 90*d* is located at a higher position than a level of the plating liquid F and the upper ends of the side walls 11*b*-11*e*. This construction prevents the plating liquid F from entering the space 93 through the sides of the cathode jig 30. Note the cathode jig 30 may be held by the lateral side 90*e*, and the anode member 20 may be held by the lateral sides 90*b* and 90*c*.

Figure 7:
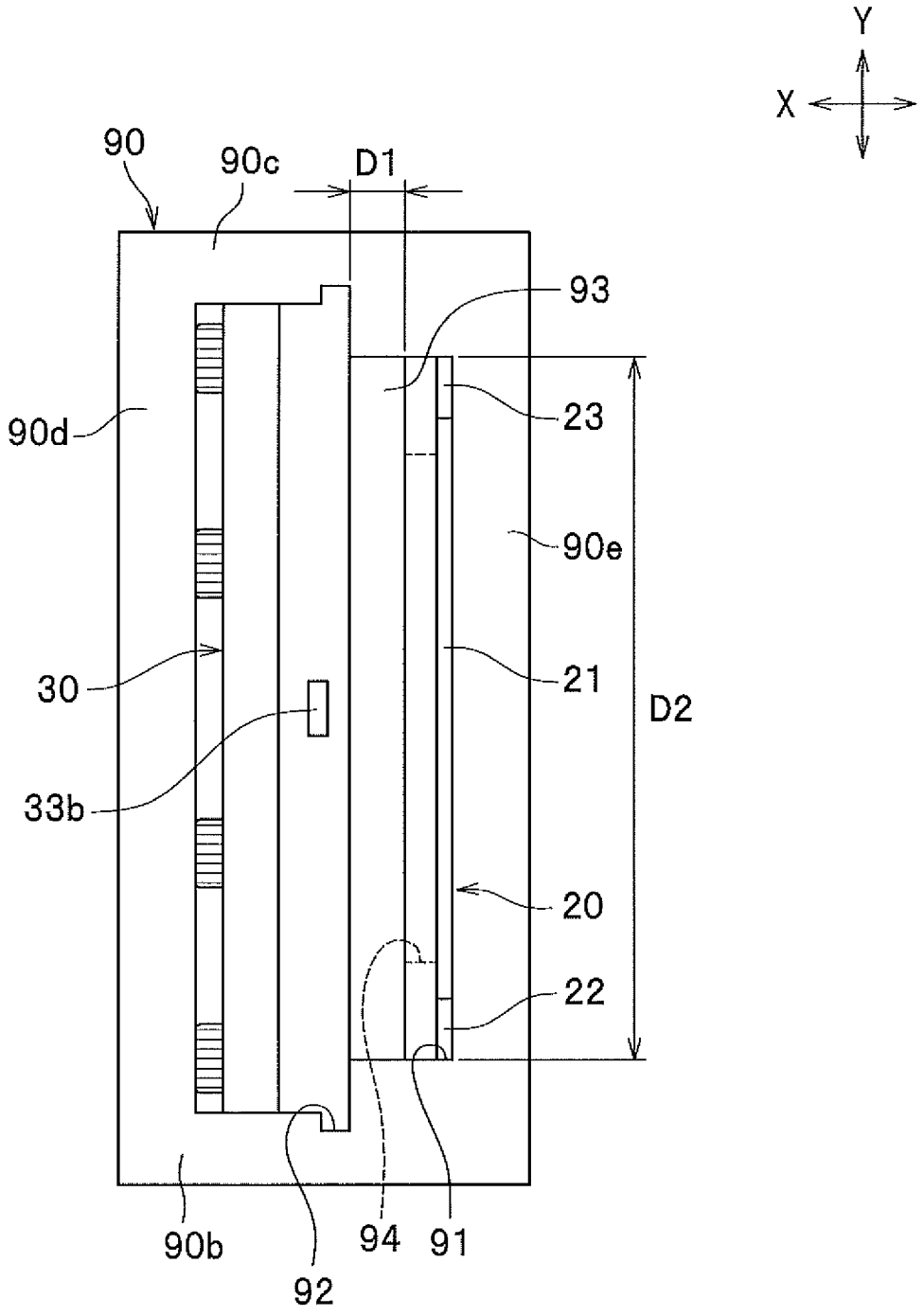
FIG. 7 is a plan view showing an appearance that an anode member and a cathode jig are housed in a container bath.

The space 93 is formed between the anode member 20 and the cathode jig 30 (i.e., and the plating object W) to be a flow passage to which the plating liquid F flows from the plating tank 10. The space 93 is a small narrow space shaped in a slit having both upper and lower openings. Both sides of the space 93 in the orthogonal direction Y are closed by the lateral sides 90*b* and 90*c* of the container bath 90. As shown in FIG. 7, the space 93 is configured so that a dimension D1 along the facing direction X is smaller than a dimension D2 along the orthogonal direction Y (i.e., D1<D2). Preferably, the dimension D1 in the facing direction X is set of, for example, from about 1 mm to about 30 mm.

Further, a flow rate of the plating liquid F flowing in the space 93 is preferably set at, for example, from about 0.1 m/s to about 3 m/s. The flow rate of the plating liquid F depends on the dimension D1 of the space 93 in the facing direction X and the performance of the pump 50. Therefore, the flow rate of the plating liquid F may be adjusted by appropriately modifying those factors.

Figure 5:
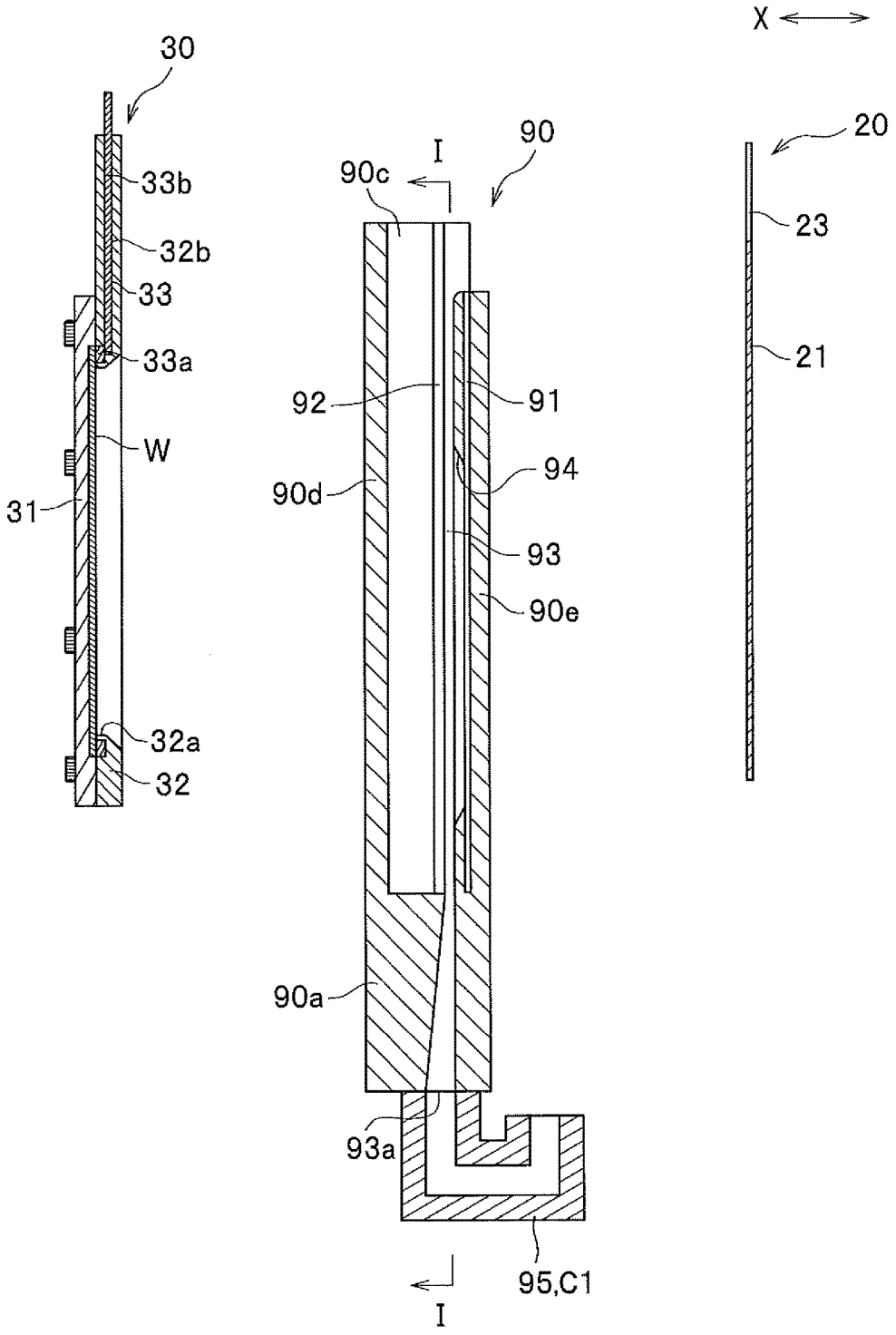
FIG. 5 is an exploded longitudinal cross-sectional view showing a container bath, an anode member and a cathode jig according to a second embodiment of the present invention.
Figure 6:
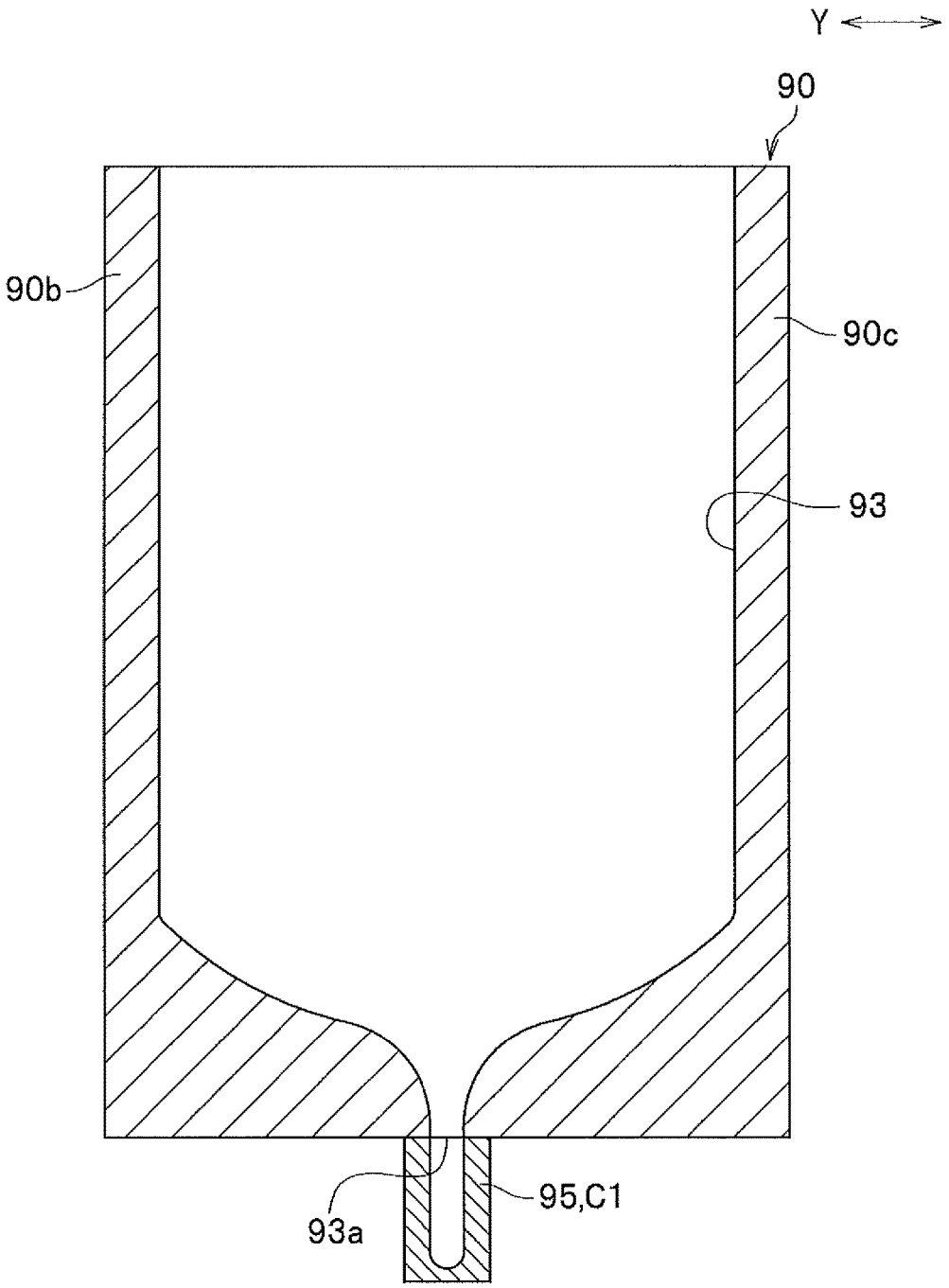
FIG. 6 is a cross-sectional view taken along a line I-I of FIG. 5.

As shown in FIG. 5, a lower part 93*a* of the space 93 is arranged extending to a lower position than the first and second holding units 91 and 92, and opened toward a bottom 90*a* of the container 90. The lower part 93*a* of the space 93 is configured so that a width viewed in the longitudinal cross-section along the facing direction X becomes wider as the lower part 93*a* extends from the upper position to the lower position. Further, as shown in FIG. 6, the lower part 93*a* of the space 93 is configured so that a width viewed in the longitudinal cross-section along the orthogonal direction Y becomes narrower as the lower part 93*a* extends from the upper position to the lower position.

As shown in FIG. 4, a plating communication hole 94 is a thorough hole used for exposing the anode member 20 to the space 93. The plating communication hole 94 is formed at a lower position than the upper end of the lateral side 90*e*.

A connector 95 is a member which is a part of a suction flow passage C1 through which the plating liquid F sucked from the space 93 by the pump 50 passes. One end of the connector 95 is connected with a lower part 93*a* of the space 93. The other end of the connector 95 is connected with a suction pipe 60 which communicates the connector 95 to the pump 50. Accordingly, in the present embodiment, the suction flow passage C1 is composed of the connector 95 and the suction pipe 60.

The pump 50 is connected with a discharge pipe 70 working as a discharge flow passage C2 through which the plating liquid F discharged from the pump 50 passes. One end of the discharge pipe 70 is opened toward a region behind the anode member 20 opposite to the space 93 in the plating tank 10. That is, in the present embodiment, the discharge flow passage C2 is composed of the discharged pipe 70 alone.

The plating apparatus M according to the second embodiment of the present invention is basically configured as mentioned above. Next, the movement and effect thereof will be described specifically.

As shown in FIG. 4, when the pump 50 is driven, the plating liquid F in the space 93 is sucked. Associated with the suction, the plating liquid F in the plating tank 10 flows over the upper end of the lateral side 90*e* and the center 21 of the anode member 20, thereby flowing into the space 93 from above relative to the space 93.

At that time, both sides of the space 93 in the orthogonal direction Y are closed, which prevents the plating liquid F from entering through the sides of the space 93. Further, the upper end of the lateral side 90*e* is located at a lower position than a level of the plating liquid F, and the upper end of the lateral side 90*d* is located at a higher position than a level of the plating liquid F. Due to this construction, the plating liquid F enters the space 93 only from a region behind the anode member 20 (i.e., only from one way in the facing direction X). Accordingly, the above construction allows the plating liquid F to smoothly flow into the space 93 from the plating tank 10 (i.e., preventing the mutual interference among the streamlines of the plating liquid F). Thereby, turbulence of the plating liquid F is prevented in the space 93.

Then, the plating liquid F flows in the space 93 from top to bottom. Herein, when the power source 80 is turned on to pass a current through the anode member 20 and the electrode 33, metal ions in the plating liquid F are drawn to the cathode jig 30. Thereby, metal is disposed on the plating object W to form a plating layer. Note a plating thickness may be adjusted by appropriately modifying a flow rate of the plating liquid F in the space 93 and a current value of the power source 80.

Next, the plating liquid F is sucked by the pump 50 from below relative to the space 93, and passes through the suction flow passage C1 toward the pump 50.

The plating liquid F thus reached the pump 50 is discharged from the pump 50. Then, the plating liquid F returns to the plating tank 10 passing through the discharge flow passage C2.

In the present embodiment as described above, substantially the same effect is exerted as in the first embodiment. Further, in the present embodiment, the container bath 90 can be used by being housed in a conventional plating tank 10. This provides an advantage of high versatility.

Figure 8:
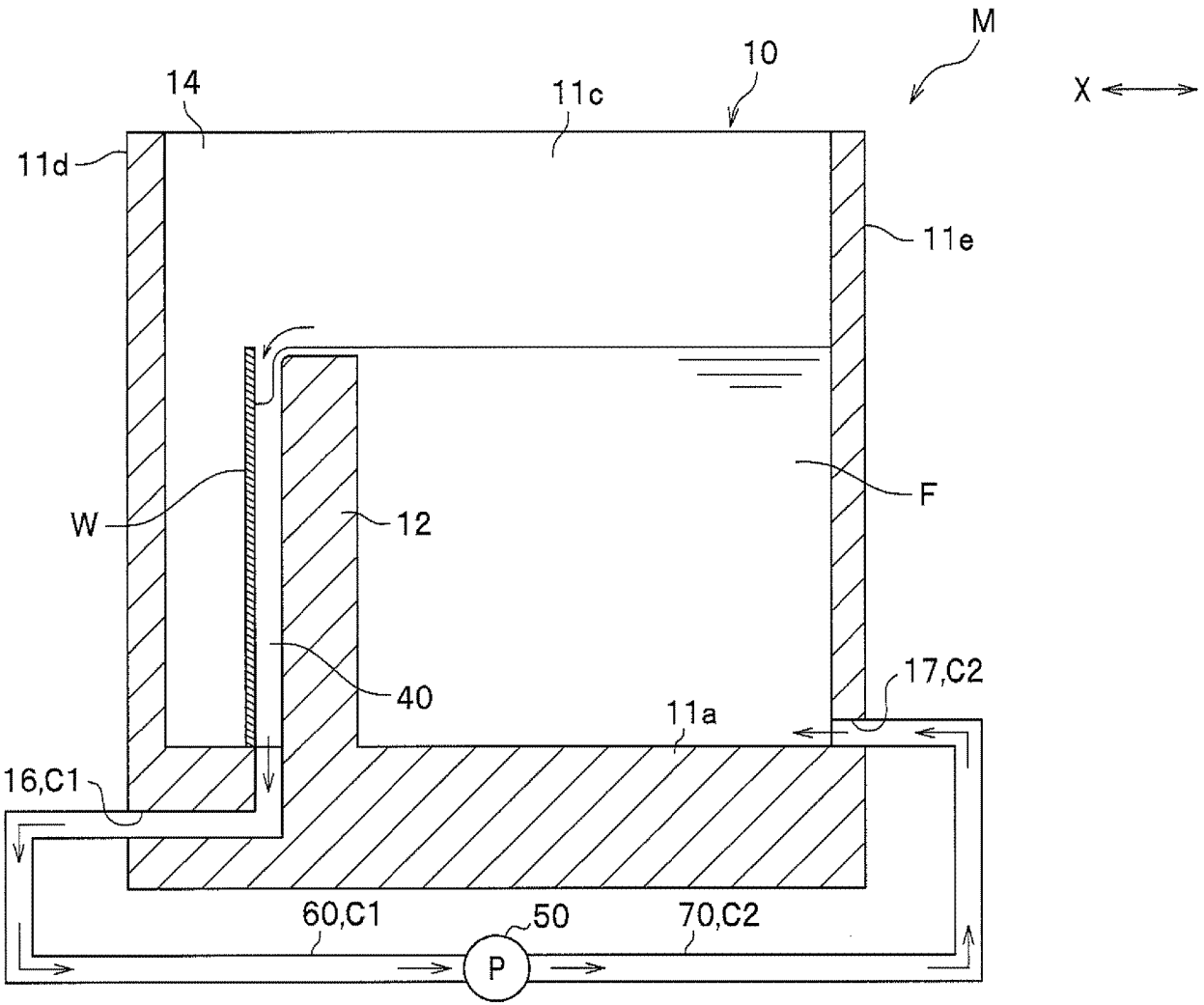
FIG. 8 is a plan view of a plating apparatus according to a third embodiment of the present invention.

Then, referring to FIG. 8, a plating apparatus M in the third embodiment of the present invention will be described specifically. A difference of the third embodiment from the first embodiment is that a plating apparatus M of the present invention is applied to electroless plating. That is, the third embodiment does not include an anode member 20 and an cathode jig 30 or the like, which is different from the first embodiment. Note the same components as in the first embodiment are put with the same references, and overlapped descriptions will be omitted.

The plating apparatus M of the third embodiment includes a plating tank 10, a plating object W, a space 40 and a pump 50.

In the present embodiment, a perpendicular wall 12 of the plating tank 10 does not include a first holder 13 and a plating communication hole 15, which is different from the first embodiment.

The plating object W is arranged inside the plating tank 10 to face the perpendicular wall 12. The upper end of the plating object W shown in FIG. 8 is located at the same height as a level of the plating liquid F. Note, although illustration is omitted, the upper end of the plating object W may be located at a higher position or a lower position than a level of the plating liquid F. Both ends of the plating object W in the orthogonal direction Y contact with the internal surfaces of side walls 11*b* and 11*c* of the plating tank 10 without any gap (Note, only the side wall 11*c* is shown in FIG. 8). Although illustration is omitted, the plating object W is held by, for example, a holder formed in the plating tank 10, in a vertical direction with respect to the plating tank 10.

The space 40 is formed between the perpendicular wall 12 and the plating object W to work as a flow passage to which the plating liquid F flows from the plating tank 10. A flow rate of the plating liquid F flowing through the space 40 is preferably set at about 0.1 m/s-about 3 m/s. More preferably, when electroless plating is carried out as in the present embodiment, a flow rate of the plating liquid F is set at about 0.1 m/s.

In the present embodiment as described above, substantially the same effect as in the first embodiment is achieved. Note that the perpendicular wall 12 may be omitted and the space 40 may be formed between the side wall 11*d* of the plating tank 10 and the plating object W. Alternatively, the space 40 may be formed between the side wall 11*e* of the plating tank 10 and the plating object W. In those cases, positions of the suction flow passage C1 and the discharge flow passage C2 may be appropriately modified. Further, in the above constructions, the side walls 11*d* and 11*e* of the plating tank 10 are the side walls described in the claims.

Figure 9:
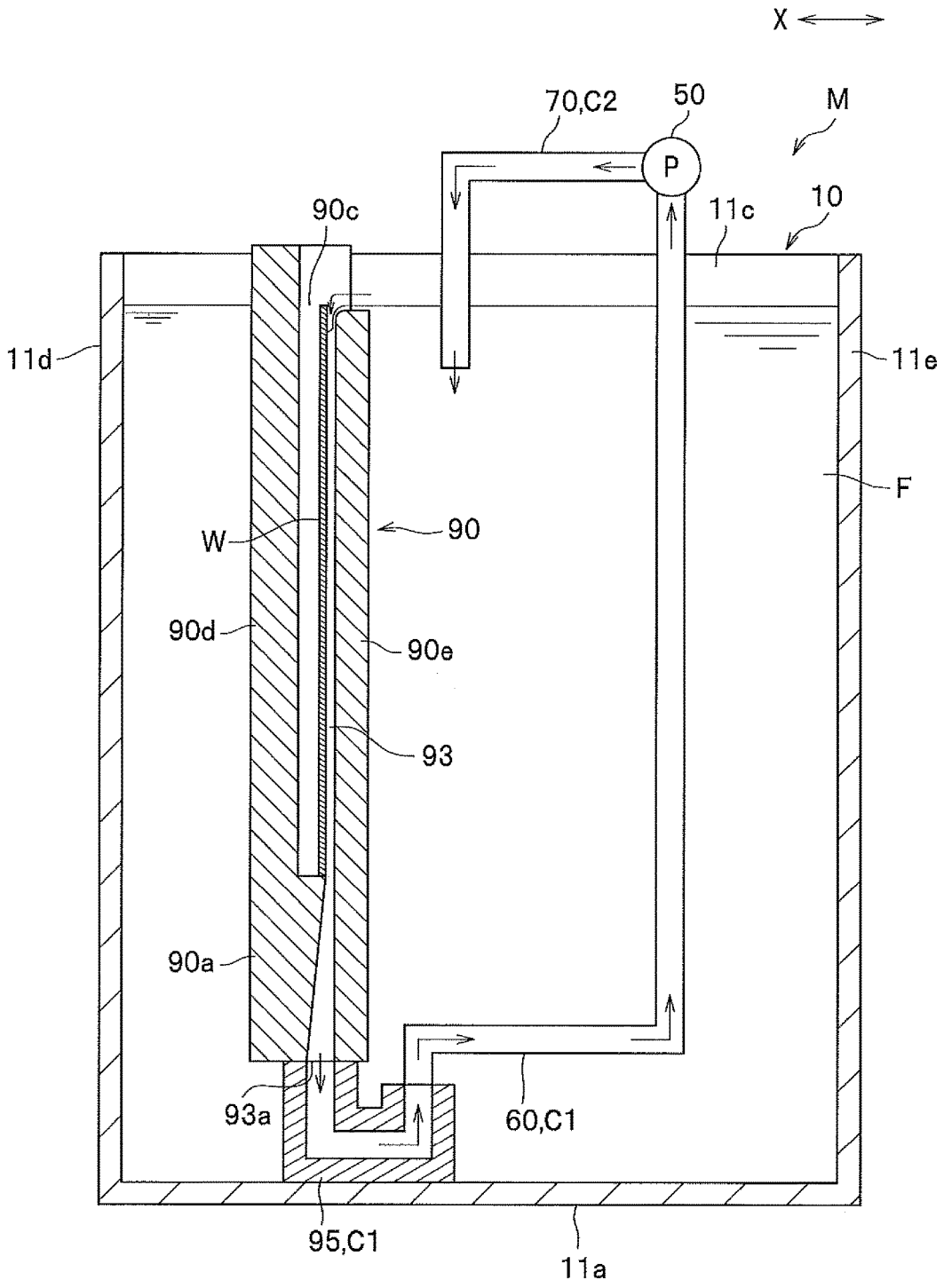
FIG. 9 is a plan view of a plating apparatus according to a fourth embodiment of the present invention.

Next, referring to FIG. 9, a plating apparatus M according to the fourth embodiment of the present invention will be described specifically. A difference of the fourth embodiment from the second embodiment is that a plating apparatus M of the present invention is applied to electroless plating. That is, the fourth embodiment does not include an anode member 20 and a cathode jig 30 or the like, which is different from the second embodiment. Note the same components as in the second embodiment are put with the same references, and overlapped descriptions will be omitted.

A container bath 90 of the fourth embodiment is arranged inside a plating tank 10, and has a function of housing a plating object W.

The container bath 90 includes the plating object W, a space 93 formed between a lateral side 90*e* and the plating object W, and a connector 95 connected to a lower part (i.e., downstream end) of the space 93. The container bath 90 of the present invention does not include the first holding unit 91, the second holding unit 92 and the plating communication hole 94, which is different from the second embodiment.

The plating object W is arranged inside the container bath 90 to face the lateral side 90*e*. The upper end of the plating object W shown in FIG. 9 is located at the same height as a level of a plating liquid F. Although illustration is omitted, the upper end of the plating object W may be located at a higher position of a lower position than a level of the plating liquid F. Both ends of the plating object W in the orthogonal direction Y contact with the internal surfaces of the lateral sides 90*b* and 90*c* of the container bath 90 without any gap (Note, only the lateral side 90*c* is shown in FIG. 9). Although illustration is omitted, the plating object W is held, for example, by a holding unit formed in the container bath 90, and arranged in a vertical direction with respect to the container bath 90.

The space 93 is formed between the lateral side 90*e* and the plating object W to work as a flow passage to which the plating liquid F flows from the plating tank 10. A lower part 93*a* of the space 93 is arranged extending to a lower position than the lower end of the plating object W, and is opened toward a bottom 90*a* of the container 90. A flow rate of the plating liquid F flowing from the space 93 is preferably set at about 0.1 m/s-about 3 m/s. More preferably, when electroless plating is carried out as in the present embodiment, a flow rate of the plating liquid F is set at about 0.1 m/s.

In the present embodiment as described above, substantially the same effect as in the second embodiment is achieved. Note that the space 93 may be formed between the lateral side 90*d* of the container bath 90 and the plating object W. In that case, positions of the suction flow passage C1 and the discharge flow passage C2 are made to be appropriately modified, and the upper end of the lateral end 93*d* is made to be located at a lower position than a level of the plating liquid F. Further, in the above construction, the lateral side 90*d* of the container bath 90 is the lateral side described in the claims.

Hereinbefore, the first to the fourth embodiments of the present invention have been described in detail referring to the attached drawings. However, the present invention is not limited to those embodiments and may be appropriately modified without apart from the scope of the invention.

For example, the first and the second embodiments show the construction in which the plating liquid F enters the space 40 or the space 93 from only one side closer to the anode member 20 (i.e., via only one way in the facing direction X). However, the present invention is not limited to the above construction. That is, the plating liquid F may enter the space 40 or the space 93 from only one side closer to the cathode jig 30 (i.e., via only one way in the facing direction X), or the plating liquid F may enter the space 40 or the space 93 from both sides of the anode member 30 and the cathode jig 30 (i.e., via both ways in the facing direction X).

Further, the third embodiment shows the construction in which the plating liquid F enters the space 40 from only one side closer to the perpendicular wall 12 (i.e., via only one way in the facing direction X). However, the present invention is not limited to the above construction. That is, the plating liquid F may enter the space 40 from only one side closer to the plating object W (i.e., via only the other way in the facing direction X), or the plating liquid F may enter the space 40 from both sides of the perpendicular wall 12 and the plating object W (i.e., via both ways in the facing direction X).

Moreover, the fourth embodiment shows the construction in which the plating liquid F enters the space 93 from only one side closer to the lateral side 90*e* (i.e., via only one way in the facing direction X). However, the present invention is not limited to the above construction. That is, the plating liquid F may enter the space 93 from only one side closer to the lateral side 90*d* (i.e., via only the other way in the facing direction X), or the plating liquid F may enter the space 93 from both sides of the lateral sides 90*d* and 90*e* (i.e., via both ways in the facing direction X).

The first to the fourth embodiments may have a construction in which an unillustrated stirring rod is provided to be put in or out the space 40 or the space 93 from above relative to the space 40 or 93. That stirring rod may be configured to swing along the orthogonal direction Y by, for example, a driving motor, so as to stir the plating liquid F in the space 40.

Further, a plurality of spatulas for stirring are provided, and the plating liquid F may be stirred by changing the angles of the spatulas.

In the first to the fourth embodiments, the pump 50 circulates the plating liquid F. However, the present invention is not limited to those embodiments. Another configuration is applicable in which the plating liquid F thus sucked may be discharged by the pump 50, and a new plating liquid F may be poured into the plating tank 10.

LIST OF REFERENCE SIGNS

M Plating apparatus
10 Plating tank
11*b*-11*e* Side walls
13 First holder
14 Second holder

20 Anode member
30 Cathode jig (i.e., Cathode member)
40 Space
50 Pump
60 Suction pipe
70 Discharge pipe
80 Power source
90 Container bath
90*b*-90*e* Lateral sides
91 First holding unit
92 Second holding unit
93 Space
C1 Suction flow passage
C2 Discharge flow passage
F Plating liquid
W Plating object
X Facing direction
Y Orthogonal direction

The invention claimed is:

1. A plating apparatus, comprising:
a plating tank storing a plating liquid;
a perpendicular wall projected upward from an inner side of a bottom of the plating tank;
an anode member arranged inside the plating tank;
a first holder detachably holding the anode member;
a plating object arranged inside the plating tank to face the anode member;
a cathode member contacting with the plating object;
a second holder detachably holding the plating object;
a space formed between the anode member and the plating object to be a flow passage to which the plating liquid flows from the plating tank, and
a facing direction in which the anode member faces the plating object, and an orthogonal direction which is orthogonal to the facing direction, wherein
both sides of the space in the orthogonal direction are closed by the plating tank,
both sides of the perpendicular wall in the orthogonal direction are continuously formed to be integral with internal surfaces of side walls of the plating tank, and an upper side of the perpendicular wall is located at a lower position than a level of the plating liquid and upper ends of the side walls,
wherein the plating liquid flows over the perpendicular wall into the space from above relative to the space, and is sucked by a pump from below relative to the space.

2. The plating apparatus described in claim 1, wherein a width dimension of the space in the facing direction in which the anode member faces the plating object is formed such that the plating liquid flows as a laminar flow parallel to the plating object.

3. A container bath arranged inside a plating tank having side walls that stores a plating liquid, comprising:
an anode member arranged inside the container bath;
a plating object arranged inside the container bath to face the anode member;
a cathode member that contacts with the plating object;
a facing direction in which the anode member faces the plating object, and an orthogonal direction which is orthogonal to the facing direction;
a pair of lateral sides facing each other in the orthogonal direction, and a pair of lateral sides facing each other in the facing direction;
a first holding unit detachably holding the anode member, and a second holding unit detachably holding the cathode member,
a space formed between the anode member and the plating object to be a flow passage to which the plating liquid flows from the plating tank, wherein
the first holding unit is formed from an upper end to a lower end of one of the pair of lateral sides facing each other in the facing direction, and arranged at a closer side to the anode member,
said upper end is located at a lower position than a level of the plating liquid and upper ends of the side walls, and an upper end of the other lateral side is located at a higher position than a level of the plating liquid and the upper ends of the side walls,
both sides of the space in the orthogonal direction are closed by the lateral sides of the container bath, and
the plating liquid enters the space only from a region behind the anode member to flow into the space from above relative to the space, and is sucked by a pump from below relative to the space.

4. A plating apparatus, comprising:
a plating tank that stores a plating liquid;
side walls of the plating tank;
a perpendicular wall projected upward from an inner side of a bottom of the plating tank;
a plating object arranged inside the plating tank to face the perpendicular wall and is held by a holder formed in the plating tank, in a vertical direction with respect to the plating tank; and
a space formed between the perpendicular wall and the plating object to be a flow passage to which the plating liquid flows from the plating tank, and
a facing direction in which the anode member faces the plating object and an orthogonal direction which is orthogonal to the facing direction, wherein,
both sides of the perpendicular wall in the orthogonal direction are continuously formed to be integral with internal surfaces of the side walls of the plating tank, and an upper side of the perpendicular wall is located at a lower position than a level of the plating liquid and upper ends of the side walls,
both ends of the plating object in the orthogonal direction contact with internal surfaces of the side walls without any gap,
wherein the plating liquid flows over the perpendicular wall into the space from above relative to the space, and is sucked by a pump from below relative to the space.

5. A container bath arranged inside a plating tank that stores a plating liquid, comprising:
lateral sides of the container bath;
a plating object arranged inside the container bath to face one of the lateral sides, held by a holding unit formed in the container bath, and arranged in a vertical direction with respect to the container bath; and
a space formed between the one of the lateral sides and the plating object to be a flow passage to which the plating liquid flows from the plating tank, wherein
both ends of the plating object in the orthogonal direction contact with internal surfaces of the lateral sides of the container bath without any gap;
the plating liquid enters the space only from a region behind the anode member to flow into the space from above relative to the space, and is sucked by a pump from below relative to the space.

* * * * *